United States Patent [19]

Epstein

[11] Patent Number: 4,641,380

[45] Date of Patent: Feb. 10, 1987

[54] ARTICLE OF HEADWEAR CONVERTIBLE BETWEEN HAT AND NECKWARMER AND METHOD

[76] Inventor: Howard D. Epstein, 249 Shore Dr. No. 6, Winthrop, Mass. 02152

[21] Appl. No.: 801,209

[22] Filed: Nov. 25, 1985

[51] Int. Cl.[4] ..... A42B 1/06

[52] U.S. Cl. ..... 2/209.1

[58] Field of Search ..... 2/209.1, 209, 201, 209.3, 2/202, 203, 91, 196

[56] References Cited

U.S. PATENT DOCUMENTS

| | | | |
|---|---|---|---|
| 787,945 | 4/1905 | Rautenberg | 2/91 |
| 1,023,677 | 4/1912 | Pass | 2/209.3 |
| 1,369,971 | 3/1921 | Goodrick | 2/202 |
| 1,547,140 | 7/1925 | Weinstein | 2/202 |
| 1,686,258 | 10/1928 | Schlesinger | 2/196 |
| 2,112,774 | 3/1938 | Thorman | 2/207 |
| 2,122,171 | 6/1938 | Alexander | 2/196 |
| 2,154,059 | 4/1939 | Alexander | 2/196 |
| 2,446,530 | 8/1948 | De Grazia et al. | 2/209.1 |
| 3,237,210 | 3/1966 | Graber | 2/209.1 |
| 3,373,447 | 3/1968 | Kim | 2/196 |
| 3,449,766 | 6/1969 | Garber et al. | 2/196 |

*Primary Examiner*—Doris L. Troutman

*Attorney, Agent, or Firm*—Litman, Day and McMahon

[57] ABSTRACT

An article of headwear convertible between use as a hat and a neck covering is provided. The article of headwear generally comprises a tubular covering of knitted fabric having a closeable side slit and a closeable end. When the side slit and end are both opened, the article is utilizable as a neck covering. When both are closed, the article is utilizable as a hat. If desired, when the side slit is closed but the ends are opened, the article may be formed into an armband for storage. In the preferred embodiment, folds may be formed in a crown portion of the hat to form a hat with a somewhat pointed or truncated crown. Methods of converting a skier's-type hat to an article of neckwear, or vice versa, are also described.

8 Claims, 9 Drawing Figures

Fig. 1.
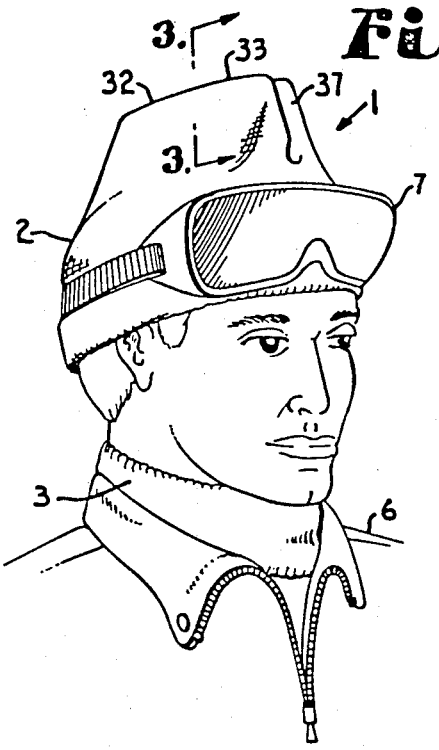
Fig. 2.
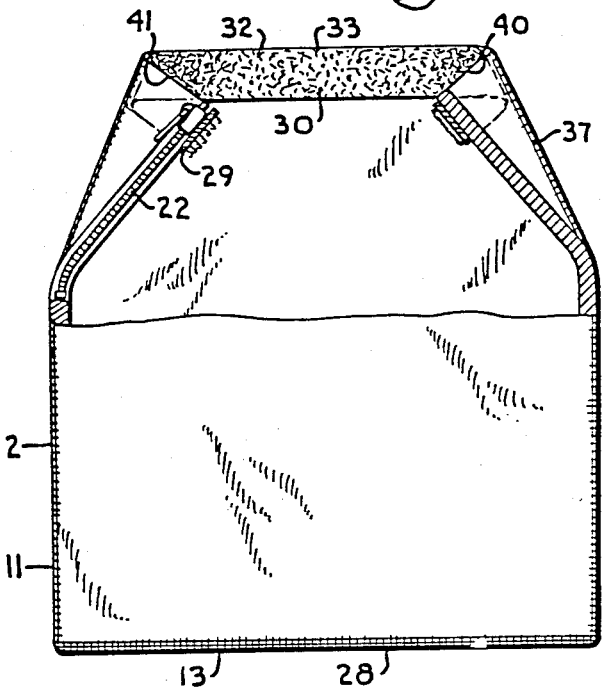
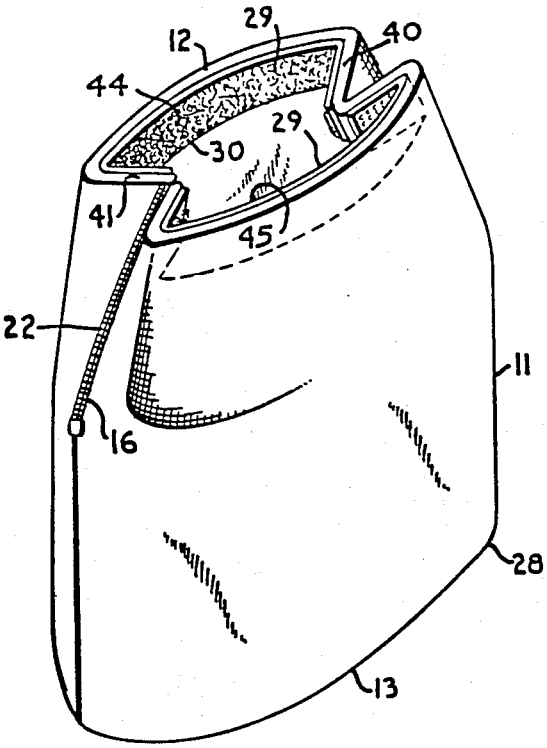
Fig. 5.
Fig. 3.
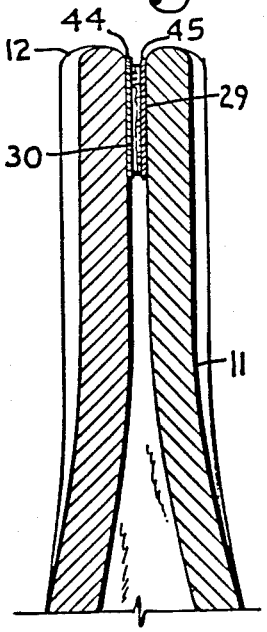

ARTICLE OF HEADWEAR CONVERTIBLE BETWEEN HAT AND NECKWARMER AND METHOD

BACKGROUND OF THE INVENTION

The present invention relates to articles of apparel and in particular to articles of headwear convertible between hats or head coverings and neckwarmers. The invention also relates to methods of converting hats into neckwarmers, and neckwarmers into hats.

While the present invention relates to headwear for numerous occasions, it is particularly well suited for the ski-wear industry. A typical skier, once fully garbed for the slopes, may encounter numerous temperature and/or environment changes during a day on the slopes. This may in part result from the numerous different environments encountered by the skier including: (a) an enclosed lift or related structures; (b) upper mountain extreme cold and winds; (c) increasing temperature while descending down the slopes; and (d) valley temperatures and winds. Further, extreme weather changes may also result in such temperature and/or environment changes.

Generally, skiers appear to prefer knitted "stocking cap" type headwear. Such headwear is comfortable, warm, light, easily washed, attractive and durable. However, as skiers, fully garbed for skiing, encounter significant temperature fluctuations in their environment, when they move up and down a mountain or into and out of lift structures and the like, sometimes they prefer wearing their hat and sometimes they prefer that the hat be removed.

When the hat is removed, problems of inconvenience may arise. Ski-wear often can be very close or "tight" in fit in order to accommodate a skier's physical exertions and reduce wind resistance. A heavy knit ski cap would not comfortably fit into the pocket of many ski outfits, or if it did it might cause an unattractive and perhaps inconvenient or bothersome bulge.

Further, since skiers may exert considerable energy during a portion of their activities, significant body heat may be generated. This may induce some skiers, either during portions of their run or otherwise, to open a portion of their outer clothing to cool off, or prevent from becoming overheated. For example, a skier might unzip or unbutton his or her outer coat. This latter, however, may expose the skier's throat and neck to the outside air. The skier may then become cooled off too much or too quickly.

Numerous articles of headwear capable of being utilized as simply a head covering, or head and neck covering, or head, neck and face covering, have been developed. Generally, these suffer from the disadvantages of being cumbersome, relatively uncomfortable, too large and bulky, or difficult to use.

OBJECTS OF THE INVENTION

Therefore, the objects of the present invention are: to provide an article of headwear, especially suited for use as a ski hat, which may be worn as a hat over a crown of the head, or which may be adjusted for use as a neck covering around the neck of a wearer; to provide such an article of headwear in which conversion from a hat to a neck covering is relatively easy to achieve; to provide a method of conversion of such a hat to such an article of neckwear; to provide a method of conversion of such an article of neckwear to such a hat; to provide such an article of headwear comprising a knitted fabric, formable, in a first mode of operation, into a hat having a truncated point portion on a top thereof; to provide such an article of headwear capable of adjustment to an orientation for use as an armband, for storage upon an arm of a wearer; to provide such an article of headwear comprising a tubular covering of knitted material, having first and second open ends and a side slit therein, with closure means facilitating closure of one of the ends and the side slit; to provide such an article of clothing comprising a tubular head covering with first and second ends and with a side slit in communication with said first end, and having a first closure means for said side slit and a second closure means for said first end, whereby said article of headwear can be readily converted between a hat and a neck covering; to provide such an article of apparel which is relatively easy to manufacture and simple to use; to provide methods of conversion of such an article of apparel between a hat structure and a neckwear structure or vice versa which are relatively simple to effect; and to provide such an article of headwear which is relatively inexpensive to produce and which is particularly well adapted for the proposed usages thereof.

Other objects and advantages of this invention will become apparent from the following description taken in conjunction with the accompanying drawings wherein are set forth, by way of illustration and example, certain embodiments of this invention.

SUMMARY OF THE INVENTION

An article of headwear is provided which is convertible between a mode in which it is utilizable as a hat, and a mode in which it is utilizable as a neck covering. When in the mode utilizable as a hat, the article of headwear simulates a fairly standard skiers' knitted stocking hat or similar cap, which covers the crown of the head of a wearer, and which may be pulled down over the wearer's ears. When in the mode in which it is utilizable as a neck covering, the article of headwear simulates a neck dickey wherein a fabric portion encircles the wearer's neck, with collar portions generally draped over shoulders of the wearer or near collar portions of the wearer's clothing. Methods of effecting conversion between the two above described modes of operation are also described.

Generally, articles of headwear according to the present invention are constructed from a knitted fabric material, such as wool. Headcoverings made from such materials are generally preferred for their comfort, durability, appearance, convenience, flexibility and inexpensiveness. Further, knitted fabric may operate well in retaining heat against the head of a wearer.

In the preferred embodiment, the article of headwear comprises a tubular covering of knitted material having a cylindrical sidewall with first and second open ends. The tubular covering is appropriately modified for conversion between a hat and the neck covering.

In particular, the modifications include a side slit communicating with an open end of the sidewall and extending substantially through the sidewall from the open end. In the preferred embodiment, if the tubular covering, which is flexible, were oriented as a cylinder with a central axis, the slit can be described as extending parallel to that axis, i.e. perpendicularly to end edges of the sidewall. As will be understood from the detailed description, in the preferred embodiment the side slit extends for a distance of approximately one-half the distance between the open ends of the sidewall, that is over a distance of approximately one-half the length of the tubular covering. However, as will be understood from the detailed description, the side slit could extend for a variety of distances, including completely through the hat.

Closure means are provided in association with the side slit and one of the ends of the cylindrical sidewall. In the preferred embodiment, the closure means is provided in the side slit and the end of the cylindrical sidewall which is in communication with the side slit. Although it is foreseeable that a single closure means, such as a single zipper, may include portions in both the side slit and the open end in communication with the side slit; in the preferred embodiment two, independent, closure mechanisms are provided: a first closure mechanism enabling the side slit to be closed; and a second, independent, closure mechanism permitting the open end of the sidewall, which is in communication with the side slit, to be closed.

Preferably, for reasons understood from the following detailed description, the closure mechanism in association with the open end of the cylindrical sidewall can be selectively opened, while the closure mechanism in association with the side slit remains closed. In this latter manner, the article of headwear may be formed into a cylinder of knitted material. As may be understood from the detailed description, such a cylinder of knitted material can be folded or rolled into a band for wearing upon an arm of a wearer, such as a skier, when the wearer prefers not to use the article as either a head covering or a neck covering.

While it will be understood that a variety of closure means such as zippers, buttons, snaps and the like may be utilized according to the present invention, in a preferred embodiment both the closure means in the side slit and in the end of the sidewall are somewhat flexible or fabric-like, so that the article of headwear will be relatively soft and comfortable as well as readily washable, durable and easily utilizable. In the preferred embodiment, the closure mechanism in the side slit comprises a zipper, preferably of a flexible type, such as vinyl, and the closure mechanism in the open end of the sidewall, which becomes a crown of the hat, is a flexible fabric hook and loop closure means such as that generally sold under the trademark VELCRO.

When the article of headwear is to be utilized as a hat, the side slit and the end including the closure means, are both closed or shut. This leaves a flexible knitted bag, with an open end, which may be pulled over a wearer's head in a manner similar to a typical, conventional, stocking cap.

In some instances, it may be preferred that a crown portion of the hat, formed from closure of the covering end having closure means, form a point or truncated point. Such pointed type caps are frequently found in ski wear.

Generally, such hats may be preferred for reasons of aesthetics. Further, such a point in a cap may result in less excess or bulk material, which may, by flopping around, disturb or irritate the wearer. Further, such pointed features may permit easier removal of a skier's goggles since the hat slopes rearwardly as it extends upwardly. Also, in particularly cold weather, a skier may prefer to pull the cap well down over his or her ears, in order to keep warm. If the hat has a somewhat pointed or truncated shape, it will tend to conform to the shape of an average person's head while leaving relatively little open volume between the head and the hat. Thus, a somewhat pointed hat may be more effective in trapping warmth and retaining it against the wearer's head.

The hat previously described, however, would not have a crown which is somewhat pointed, or presents a truncated point. Rather, the top of the hat would have a flat edge of a length substantially equivalent to one-half of a perimeter of the cylindrical sidewall. In order to form a truncated point in the hat, according to the method of the present invention, approximately equal and opposite pinch folds or point forming folds are formed in the hat crown portion during closure of the tubular sidewall open end. In the preferred embodiment these folds comprise internally directed dimples or pinchfolds formed prior to engaging the end or crown forming closure mechanisms. The method of forming these folds will be understood from the following detailed description, from which it will also be understood that should a single closure means, such as a zipper, be utilized for both the tubular sidewall and the side slit, a method of forming the pointed crown is still available.

When the article of headwear is to be utilized as a neck covering, closure means in the tubular sidewall end and the side slit are open. The neck covering is then pulled onto the wearer by slipping over the wearer's head and pulling downwardly until the wearer's head extends outwardly from the tubular sidewall, with the wearer's neck being covered by the article. The side slit provides for an opening of the tubular sidewall to facilitate pulling the covering over the wearer's head and further to form an open collar portion facilitating the wearer's comfort. Generally, it will be understood, from the detailed description, that as a neck covering, the article of headwear is preferably usually worn with the wearer's head extending outwardly from the end of the tubular sidewall which is not in communication with the side slit. However, an opposite orientation is possible, and may be preferred by some wearers, in part because it gives an appearance of a full collar.

When worn as a neck covering, the article of headwear is similar to a turtleneck or neck dickey. This permits the wearer to keep his or her neck warm even when the wearer's coat is opened. Also, an edge of it may be folded double, for comfort, warmth, or attractive appearance as desired. If worn with the head protruding from the end in communication with the side slit, the side slit may provide an attractive collar.

In some instances, the skier or wearer may prefer not to wear the article as either a hat or a neck covering. Under such circumstances, the article of headwear according to the present invention is readily adaptable for wearing as an armband or legband, and the article may be conveniently "stored" if the wearer does not wish to utilize the warmth the article provides, but wishes to keep the article of headwear on his or her person. In this manner, stuffing of the article of headwear into a pocket or elsewear is avoided, as well as unslightly, uncomfortable or distracting bulges in the wearer's clothing.

In order to convert the article of headwear into an armband, the closure mechanism in the tubular sidewall end is opened, while the side slit closure mechanism generally remains closed. In this orientation, the article of headwear comprises a knitted tube which may be folded into an armband or legband and worn over the outside clothing of the wearer. It will be understood from the detailed description that in the preferred embodiment it is not absolutely necessary that the side slit closure means be closed in this orientation, however it will generally be preferred for appearance and comfort.

When worn as an armband or legband, if appropriately colored, the article may also provide an attractive decoration. Further, it may act as a means to increase an outer circumference of a band around the wearer's arm, and may be utilized to store the skier's goggles. Typically, a skier's goggles will have a head band so large that, when a skier removes his goggles, it might not be easily stored upon the skier's arm. However, if placed over the armband provided by the article of headwear, the goggles may fit more snuggly and comfortably. Some skiers may wish to partially fold their goggles within the knitted article, and then store them upon an arm.

It is foreseen that in some circumstances, by opening the article of headwear into an open tube, the article may form a headband capable of covering the wearer's ears and the sides of a wearer's head while leaving an upper portion or the crown portion of the wearer's head exposed. This may be comfortable for a wearer who wishes to have his or her ears covered, but the top of the head exposed for comfort and cooling.

The drawings constitute a part of this specification and include exemplary embodiments of the present invention and illustrate various objects and features thereof. In some instances material thickness may be illustrated exaggerated, or reduced, for clarity.

BRIEF DESCRIPTION OF THE DRAWINGS

FIG. 1 is a perspective view of an article of headwear according to the present invention, shown being worn by a wearer as a hat.

FIG. 2 is an enlarged side plan view of an article of headwear according to the present invention, shown oriented as a hat and with portions broken away to show internal detail.

FIG. 3 comprises an enlarged rear, fragmentary, cross-sectional view of an article of headwear according to the present invention taken generally along line 3—3 of FIG. 1.

FIG. 5 comprises an enlarged side perspective view of an article of headwear according to the present invention, shown being converted from a hat to a neck covering, or vice versa.

DETAILED DESCRIPTION OF THE PREFERRED EMBODIMENT

Figure 4:
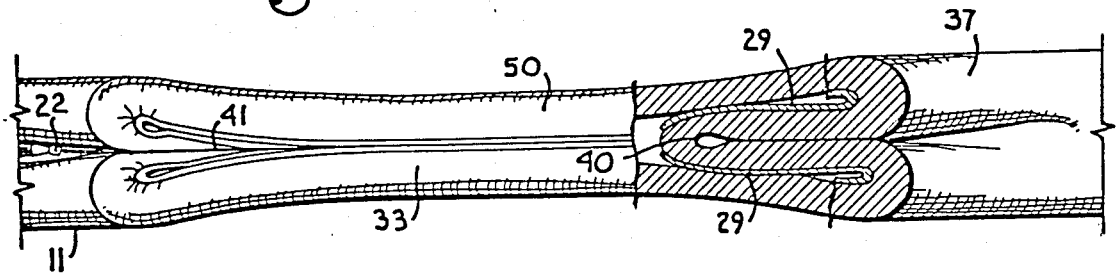
FIG. 4 is an enlarged, fragmentary, top plan view of an article of headwear according to the present invention, shown oriented as a hat or head covering as in FIG. 1, and with portions broken away to show internal detail.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but rather merely as a basis for the claims and as a representative basis for teaching one skilled in the art to variously employ the present invention in virtually any appropriately detailed structure.

The reference numeral 1, FIG. 1, generally designates an article of headwear according to the present invention. The article of headwear 1 is convertible between a hat or head covering 2, FIG. 1, and a neck dickey, or neck covering 3, FIG. 7.

In the preferred embodiment, when the article of headwear 1 is in a mode for use as a hat 2, it simulates a conventional ski type or stocking type hat. In FIG. 1, the hat 2 is shown being worn by a skier 6. Preferably, the hat 2 is formed from a flexible knitted fabric, such as wool, for warmth, comfort, durability, relative ease of washing, stretchability and similar features. In FIG. 1, the skier 6 is shown wearing goggles 7, stored upon the forehead in a conventional manner. It will be understood that should the skier 6 desire, the hat 2 may be pulled further down over his head in order to more fully cover his ears for warmth. In this manner, the hat 2 is similar to a conventional stocking cap.

Figure 8:
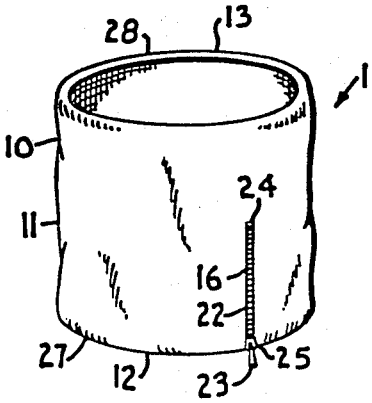
FIG. 8 is a side perspective view of an article of headwear according to the present invention, shown during a stage of conversion between utilization as a hat and as a neck covering, wherein the article is oriented for possible use as an armband.

Referring to FIG. 8, preferably the article of headwear 1 comprises a flexible tube 10 of knitted material having a tubular or cylindrical sidewall 11, with a first open end 12 and a second open end 13. Herein, the tubular sidewall 11 will be referred to as cylindrical; however, it will be understood that since it is preferably formed from flexible material it will generally conform to the shape of a wearer's head or neck and need not retain a cylindrical shape. Further, as will be understood from the following detailed description, the tubular sidewall need not be precisely cylindrical, for example it might be somewhat conical or have a non-circular cross-section. The principles of the invention could be readily adapted to a variety of shapes of sidewalls, however, generally, substantially cylindrical ones may be preferred for comfort and ease of manufacture.

Figure 6:
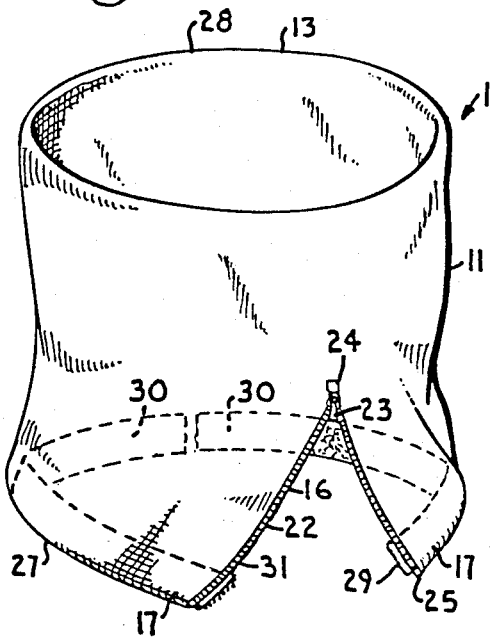
FIG. 6 comprises an enlarged side perspective view of an article of headwear according to the present invention shown oriented for use as a neck covering.

Referring to FIGS. 6 and 8 the sidewall 11 includes a side slit 16 therein. The side slit 16 generally extends substantially inwardly of the sidewall 1 from one of the ends 12 or 13 thereof. In the preferred embodiment, FIGS. 6 and 8, the side slit 16 communicates with a first end 12 of the sidewall 11. However, it will be understood from the detailed description, taken in conjunction with the drawings, that the side slit could be oriented to communicate with the secohd end 13 of the sidewall 11.

By "substantially inwardly" it is meant that the side slit 16 extends over a sufficient distance to permit collar portions 17, FIGS. 6 and 7, to be described in further detail below, to be formed in the sidewall 11. This may include side slits which extend completely through the side wall, i.e. from one end to the other. Generally side slits extending from between approximately one-third to two-thirds of a distance between the first open end 12 and second open end 13 will be preferred, however other arrangements will be possible. In the preferred embodiment, FIGS. 6 and 8, the side slit 16 is shown extending approximately one-half of the distance between the first end 12 and the second end 13 of the sidewall 11. This is believed to be the most desirable length of side slit 16, for comfort and ease of use of the article 1 by a variety of different wearers. It is foreseen that in some instances the side slit might extend completely through the sidewall, enabling it to be opened into a somewhat rectangular shaped piece of material.

As will be seen by reference to the drawings and the following description, convertibility of the article 1 between a hat 2 and neck covering 3 is facilitated by closure means, including a first or side slit closure portion and a second or end closure portion, present in one of the ends 12 or 13 and also in the side slit 16. Referring to FIGS. 6 and 8, the closure means or closure portion in the the side slit 16 permits the slit to be completely closed, FIG. 8, to form the tube or cylinder 10. If open, FIG. 6, the closure means permits the side slit 16 to form a rip in the sidewall 11, and form collar portions 17. It is noted that if the side slit were to extend completely through the sidewall, the closure means would permit the side slit to open analogously to FIG. 6 only if it were partially opened.

It will be understood that a variety of closure means or mechanisms may be utilized in the side slit 16. For example, buttons, snaps, zippers, or flexible hook and loop closure systems such as that sold under the trademark VELCRO might be used. In the preferred embodiment, FIGS. 6 and 8, a zipper or zipper mechanism 22 is shown mounted adjacent to side slit 16. In FIG. 6, the zipper is shown open, or "unzipped". In FIG. 8, the zipper is shown closed or "zipped". In the preferred embodiment the zipper 22 is shown oriented so that during closing, the fastener 23 travels along the side slit 16 from an end 24 of the side slit 16 centrally located in the sidewall 11 to a terminus 25 adjacent the first open end 12. It will be readily understood from the detailed description and the drawings, that in alternate embodiments, the zipper 22 may be oriented to close in an opposite direction.

Referring again to FIG. 8, a preferred direction of extension for the side slit 16 and zipper 22 is perpendicular to an end edge 27 or 28, of the sidewall 11. Alternately stated, if the sidewall 11 were oriented as a cylinder 10, FIG. 8, it would be understood to have a central longitudinal cylindrical axis. The preferred directions of extension of the side slit 16 and zipper 22 are parallel to this axis. It will be further understood that such a direction of extension is not required. However, from reference to FIGS. 6 and 7, it will be understood that such a direction of extension for the side slit 16 may result in a preferred, generally symmetrical, formation of the collar portions 17.

As indicated above, the closure means also facilitates closure of one of the ends 12 or 13 of the sidewall 11. While either end, 12 or 13, may be closed, according to the present invention, generally it will be preferred that the closure means facilitate closing of the end 12, FIGS. 6 and 8, which is in communication with the side slit 16. In this manner the sidewall 11 has an upper edge 28, FIGS. 6, 7 and 8, which will be attractive in appearance, comfortable, and uninterrupted by the presence of closure means. That is, when the article 1 is utilized as a neck cover 3, FIG. 7, much of the closure means can be oriented out of view, if desired.

It will be understood that when the closure means or mechanism in the open end 12 or 13 is closed, the article 1 comprises a bag-like arrangement, with one end of the flexible cylinder 10 closed, and the other end opened. In this orientation the article 1 comprises a hat which may be pulled over a wearer's head by the open portion.

From the above, it will be readily understood that a variety of closure means may be utilized in the end, in FIG. 8 end 12, of the sidewall 11 which is to be closed. For example, snaps, buttons, zippers, or flexible fabric hook and loop closure systems such as that sold under the trademark VELCRO might be utilized. In the preferred embodiment illustrated and described, a hook and loop closure system 29, such as VELCRO, is utilized, FIGS. 5 and 6. In FIG. 6 flexible strips 30 of material for such a closure system 29 are shown mounted along an inside surface 31 of the sidewall 11 and adjacent edge 27 or near the open end 12. Such a closure system readily operates by pressure against sides of the hook and loop system 29 in a conventional manner.

Referring to FIGS. 1 and 2, in stocking caps, it is often preferred that the crown portion 32 of the hat form a point or truncated point 33. Such points 33 may have have numerous purposes or advantages.

First, it may be preferred for aesthetic reasons. Also, it may avoid excess material which could flop about over the forehead of a wearer, in an irritating and distracting manner.

Further, by reference to FIGS. 1 and 2, it will be understood that the truncated point 33 results in part from a sloping forward edge 37. Since the crown portion 32 of the hat 2 slopes rearwardly along edge 37, as it extends upwardly, when a skier, FIG. 1, removes his goggles by lifting them over his head, the hat 2, by sloping rearwardly, is less likely to become caught or otherwise obstruct the removal.

Further, if the skier becomes particularly cold he or she will be inclined to pull the hat 2 downwardly over the head and ears as much as possible. Should this occur, such pointed or truncated hats may generally snugly conform to the crown of the head of the wearer for warmth and comfort. That is, in the absence of such truncation, greater air pockets between the wearer's head and the hat may be present, with a possible result being less efficient trapping of warmth.

From the above, it will be understood that a hat 2 having a truncated point 33 may be preferred. Referring to the previous description, and FIG. 8, should the end 12 be simply closed, the resulting bag shaped hat would not have such a substantial truncated crown portion. However, applicant has provided an article of headwear 1 in which such a truncated portion 32, as shown in FIG. 1, can be easily formed. This will be understood by reference to FIG. 5 and the following description.

Due to the utilization of a flexible closure member 29 in the open end 12, folds can be formed in the edge 27 of the sidewall 11 adjacent the open end 12. In FIG. 5 two such dimples or pinch-folds, 40 and 41, are shown. Preferably the folds 40 and 41 are oppositely oriented in the end 12 of the hat 2. Further, in the preferred embodiment, fold 41 is centrally or symmetrically oriented about the zipper 22. The reason for this will be understood by reference to FIG. 2. In FIG. 2 a side view of the hat 2 is shown, fragmented to show inner portions of the folds 40 and 41. From reference to FIG. 2, it will be understood that the zipper 22 will be generally hidden within the fold 41 of the hat 2. This leads to a more attractive appearance, and helps prevent the zipper from becoming blocked by snow or ice.

Referring again to FIG. 5, following the formation of the folds 40 and 41 when the resulting opposite sides 44 and 45 are pressed together, collapsing the pinch folds 40 and 41 therebetween and engaging the closure mechanism 29, the hat 2, FIGS. 1 and 2, is formed with a truncated, pointed-type crown 32. In FIG. 3, a cross section of FIG. 1, the engagement of opposite sides 44 and 45 of the closure means is shown. In FIG. 4, a top view of the hat 2, FIG. 1, portions are shown broken away to show a pinch fold of material 40 beneath an upper edge 50 of the hat 2.

Figure 7:
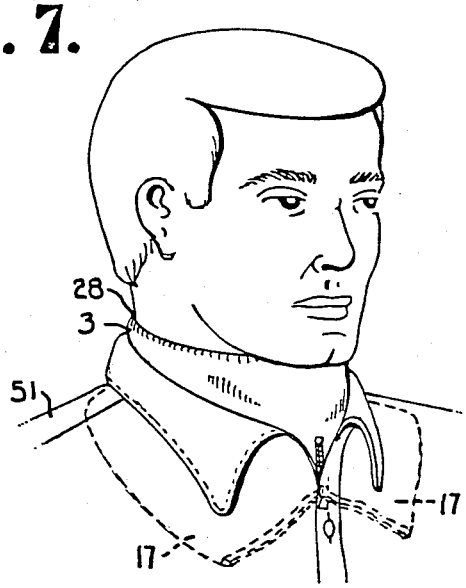
FIG. 7 is a perspective view of an article of headwear according to the present invention, shown being worn as a neck covering by a wearer.

By reference to FIGS. 6, 7 and 8, it will be understood how the article of headwear 1 may be utilized as a neck covering 3. Further, it will be understood how the hat 2 can be converted to such a neck covering 3. Generally, after removal of the hat 2 from the head, the wearer opens the closure means, including opening of the closed end 12 and the side slit 16. This will result in the article 1 having an appearance generally as shown in FIG. 6. Referring to FIG. 7, to wear the article 1 as neckwear, the wearer inserts his or her head through the inside of the covering or tubular sidewall 11. Preferably this insertion is made with the collar portions 17 of the neck covering 3 resting in front of the wearer's collar area. These may be tucked underneath the collar portions of the wearer's shirt or coat for an attractive appearance. The result will be that the neck covering 3 simulates a turtleneck or neck dickey, FIG. 7. In FIG. 7, the collar portions 17 of the neck covering 3 are shown tucked under the wearer's shirt 51. The collar portions 17 formed from the open slit 16, help prevent a bunching of excess material under the wearer's chin. The slit 16 also makes it easier to pull the side wall 11 over the wearer's head. It will be understood that if desired a portion 52 of the tubular covering 3 surrounding the wearer's neck can be folded double for a preferred appearance, comfort, or further added warmth.

It is foreseeable that some wearers may prefer to orient the article 1, when worn as a neck covering 3, oppositely to the manner shown in FIG. 7. That is, with the collar portions 17 near the wearer's chin, and with the edge 28, near the shoulders. In this orientation, the side slit 16 might be closed or partially closed to form a turtleneck arrangement. Alternatively, the collar portions 17 could be curved over the shoulders to form a collar with collar points.

There may be time when a wearer, such a skier, prefers not to wear the article 1 as either a hat 2 or a neck covering 3, as for example when the skier reaches a portion of a slope which is particularly warm. In the past skiers have generally had to stuff their stocking hats into a pocket or fold in their clothing. This could result in an uncomfortable or unslightly bulge, which could possibly interfere with freedom of movement. Further, in some instances ski clothing may be sufficiently tight or form fitting so as to not permit easy storage of a hat.

Figure 9:
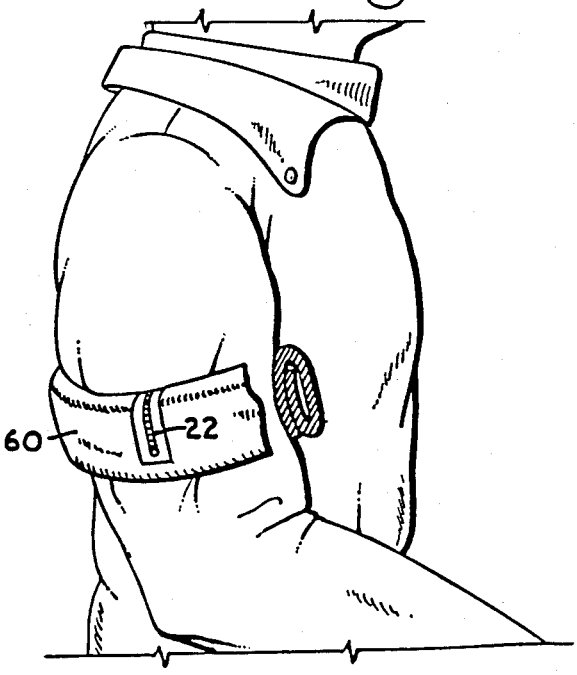
FIG. 9 is a fragmentary, side perspective view of an article of headwear according to the present invention shown being worn by a wearer as an armband.

The instant invention accommodates this problem. This will be understood by reference to FIGS. 8 and 9. If the article 1 is oriented with the side slit 16 closed, but with both sidewall ends 12 and 13 open, it generally forms a cylinder 10, FIG. 8. This is accommodated by having actuation means associated with the end closure portion which enables the end 12 to be opened when the side slit 16 is closed. This cylinder 10 may be folded into an armband 60, FIG. 9. In FIG. 9, the armband 60 is shown formed from a tri-fold in the cylinder 10, however it will be readily understood that alternate folding may be utilized. Further, it is foreseeable that the armband could be formed even when the side slit 16 is not closed. The armband provides for ready storage of the article 1 around an arm of a wearer, and if a sufficiently colorful material is utilized, an attractive decoration may result.

Generally, the armband 60 is such that it will not interfere with freedom of movement of the wearer. Further, the same skier may have goggles which may need to be stored. Often, these are worn around the forehead, FIG. 1, or hanging from the neck. In either instance, they may distract or irritate the wearer and they may not be securely held. However, due to their size and bulk, they have not, in the past, been readily storable elsewhere. Referring to FIG. 9, the armband 60 provides a location where the goggles 7 might be stored. This would be done by simply slipping the goggles over the armband 60, with a head band on the goggles stretching around the armband 60. The large circumference of the armband 60, when added to a wearer's arm, especially if the wearer has on a significantly large coat, will generally aid in supporting the goggles in a secure manner. It is foreseen that in some instances the goggles might actually be folded into a portion of the armband 60.

It will be understood that the band 60 might be worn elsewhere, as for example as legband.

Some wearers may prefer to utilize the article 1 as an ear and forehead covering, while permitting an upper portion of the head to be exposed. This could be accommodated by arranging the article 1 similarly to FIG. 8. That is, the article 1 could be worn with the side slit 16 closed, but with both ends 12 and 13 open. This would leave an opening in the crown portion over the wearer's head, permitting the wearer's head to breathe or cool. It is foreseen that if desired, the excess fabric could be folded out of the way in whatever manner appeared comfortable or attractive to the wearer.

For some applications of the invention the closure means may comprise a single closing member, such a single zipper, which extends both through the side slit and an adjacent end in the covering. That is, a single zipper would be capable of closing both the side slit and the adjacent open end. While this is not shown in the drawings, it will be readily understood that under such circumstances it would be preferred that during closing, the fastener 25 begin at the end of the side slit centrally located in the sidewall and first close the side slit, then close the open end. In this manner, the single zipper, if desired, could be stopped when the sidewall has been formed into a cylinder analogous to that shown in FIG. 8, with the side slit closed but the closeable end open.

The utilization of a single zipper to actuate closing of the slit 16, and the adjacent open end, does not preclude the formation of a truncated point in the hat. However, its method of formation would be somewhat different. It is foreseen that the truncated point, under such circumstances, would be formed as follows:

Following closure of the side slit and the open end with a zipper, the resulting hat would be turned completely inside out. If appropriate fastening means were positioned in the "corners" of the hat along the closed edge, the corners could be folded inwardly, toward one another, to form a point. The fastening means would be used to connect the corners to one another and retain the point. If the hat were then returned to a "right side out" orientation, the appearance would be similar to that of the hat 2 in FIG. 1, but perhaps with a somewhat more pointed crown.

While a variety of sizes of headwear may be formed which utilize the principles of the instant invention, dimensions generally resulting in a comfortable article of headwear for an average person are: (a) with a distance between the first and second ends, 12 and 13, of the tubular sidewall being approximately 10 inches or about 26 centimeters, and; (b) with a perimeter of either of the open ends 12 or 13 being approximately 19 inches or about 25 centimeters. With the above dimensions, as previously indicated, a preferred side slit is approximately 5 inches, or about 13 centimeters long.

From the previous description and the drawings, a general method of converting a stocking of ski-type hat to a neck covering will be understood. This will be accommodated by providing an appropriate side slit and an opening in a crown portion of the hat, analogous to those described and shown. It will be understood that if the side slit provided extends completely through the sidewall, then means should be provided to enable it to be partially open. The result would generally be an article of neckwear having an appearance similar to that of the article 1 shown in FIG. 6. This can be readily worn as a neck covering, as described and shown in FIG. 7. Similarly, a reverse method to yield a hat from a neck covering, is also readily understood.

It will be understood that if desired, a wearer could utilize more than one article according to the present invention at a given time. For example, one may be utilized as a hat and another utilized as a neck covering, FIG. 1. If the wearer should decide to remove either one or both, it can be readily stored upon an arm in the manner described. This is particularly advantageous since it might be particularly difficult to store a conventional hat and also neck warmer in the average ski wear.

It is to be understood that while certain forms of the present invention have been illustrated and described herein, it is not to be limited to the specific forms or arrangement of parts described and shown.

What is claimed and desired to be secured by Letters Patent is as follows:

1. An articles of headwear which is selectively convertible between a neck warmer and a head covering, said article comprising:

(a) a covering having a tubular sidewall and first and seond open non-tapered ends;

(i) said sidewall having a side slit therein, said side slit extending substantially inwardly of said covering from said covering first end and being in communication with said covering first end;

(b) closure means including first and second closure portions;

(i) said first closure portion being permanently mounted in said article generally along said side slit and enabling selective closure of said side slit; said first closure portion permitting selective opening of said side slit from said covering first end inwardly of said covering;

(ii) said second closure portion being permanently mounted in said article generally along said covering first end and enabling selective closure of said covering first end;

(c) whereby in a first mode of operation said article of headwear is utilizable as a head covering by selective closure of said first and second closure portions and fitting said covering over a wearer's head by means of said covering second end; and (d) whereby in a second mode of operation said article of headwear is utilizable as a neck warmer by selective opening of said first and second closure portions and pulling said covering over a wearer's head to position said covering around the wearer's neck, with the wearer's head extending outwardly from one of said covering ends.

2. An article of headwear according to claim 1 wherein:

(a) said closure means comprises a single zipper closure oriented to first open along said covering first end and to open second along said side slit.

3. An article of headwear according to claim 1 wherein:

(a) said second closure portion comprises a flexible hook and loop closure system;

(i) said hook and loop closure system enabling closure of said covering first end with formation of first and second generally opposite pinch-folds therein;

(ii) said first closure portion being selectively substantially positionable within one of said first and second pinch-folds;

(b) whereby in said first mode of operation of pointed closed end may be selectively formed in said article of headwear to provide a pointed portion in said head covering and a pinch-fold generally covering said first closure portion to keep same out of view and to minimize exposure of said first closure system to the elements.

4. A method of converting a hat to a neck warmer, said method comprising the steps of:

(a) providing a hat comprising a covering having a tubular sidewall, a first, closed, end and a second, open, end;

(b) opening said covering first end, to form a generally tubular member with a first open end and an opposite second open end, said opening being by providing an end slit extending generally completely across said covering first, closed, end; and (c) providing a side slit in said tubular member, said side slit extending partially inwardly of said tubular member from said tubular member first end;

(d) whereby a resulting structure may be pulled over a wearer's head, to encircle the wearer's neck as a neck warmer, with said side slit forming collar portions, the collar portions being positionable underneath a jacket worn by the wearer.

5. A method of converting a neck warmer to a hat, said method comprising the steps of:

(a) providing a neck warmer having a covering with a tubular sidewall;

(i) said tubular sidewall having first and second, open, ends;

(ii) said tubular sidewall having a side slit therein; said side slit extending inwardly of said sidewall from one of said sidewall open ends;

(iii) said side slit forming collar points in said neck warmer positionable underneath a jacket worn by a wearer of said neck warmer and in front of a wearer's shoulders;

(b) closing said side slit to provide a tubular member;

(c) closing one of said sidewall open ends;

(d) whereby a resulting structure is utilizable as a hat by pulling a remaining open end over a wearer's head.

6. An article of headwear which is selectively convertible between a neck warmer and a head covering, said article comprising:

(a) a covering having a tubular side wall and first and second open ends;

(i) said sidewall having a side slit therein, said side slit extending completely between said first and second open ends of said tubular sidewall in a direction substantially perpendicular thereto;

(b) closure means including first and second closure portions;

(i) said first closure portion being permanently mounted in said article generally along said side slit and enabling selective closure of said side slit; said first closure portion permitting selective opening of said side slit from said covering first end inwardly of said covering;

(ii) said second closure portion being permanently mounted in said article generally along said covering first end and enabling selective closure of said covering first end;

(c) whereby in a first mode of operation said article of headwear is utilizable as a head covering by selective closure of said first and second closure portions and fitting said covering over a wearer's head by means of said covering second end; and (d) whereby in a second mode of operation said article of headwear is utilizable as a neck warmer by selective partial opening of said first closure portion and substantially complete opening of said second closure portion and pulling said covering over a wearer's head to position said covering around the wearer's neck, with the wearer's head extending outwardly from one of said covering ends.

7. An article of headwear which is selectively convertible between a neck warmer and a head covering, said article comprising:

(a) a covering having a tubular sidewall and first and second open non-tapered ends;

(i) said sidewall having a side slit therein, said side slit extending substantially inwardly of said covering from said covering first end and being in communication with said covering first end;

(b) closure means including first and second closure portions;

(i) said first closure portion being permanently mounted generally along said side slit and enabling selective closure of said side slit;

(ii) said second closure portion being permanently mounted in said article generally along said covering first end and enabling selective closure of said covering first end.

(c) whereby in a first mode of operation said article of headwear is utilizable as a head covering by selective closure of said first and second closure portions and fitting said covering over a wearer's head by means of said covering second end; and (d) whereby in a second mode of operation said article of headwear is utilizable as a neck warmer by selective opening of said first and second closure portions and pulling said covering over a wearer's head to position said covering around the wearer's neck, with the wearer's head extending outwardly from one of said covering ends.

8. An article of headwear according to claim 7 wherein:

(a) said second closure portion comprises a flexible hook and loop closure system;

(i) said hook and loop closure system enabling closure of said covering first end with formation of first and second generally opposite pinch-folds therein;

(ii) said first closure portion being selectively substantially positionable within one of said first and second pinch-folds;

(b) whereby in said first mode of operation a pointed closed end may be selectively formed in said article of headwear to provide a pointed portion in said head covering and a pinch-fold generally covering said first closure portion to keep same out of view and to minimize exposure of said first closure system to the elements.

* * * * *